United States Patent [19]

Jacobson, Jr. et al.

[11] 4,390,304

[45] Jun. 28, 1983

[54] CRUSHED ROCK APPLICATOR MECHANISM

[75] Inventors: Carl C. Jacobson, Jr., Tempe; Mark C. Manning, Chandler, both of Ariz.

[73] Assignee: Crafco, Inc., Chandler, Ariz.

[21] Appl. No.: 365,198

[22] Filed: Apr. 5, 1982

[51] Int. Cl.[3] ..... E01C 19/20

[52] U.S. Cl. ..... 404/110; 404/108

[58] Field of Search ..... 404/108, 110

[56] References Cited

U.S. PATENT DOCUMENTS

| | | | |
|---|---|---|---|
| 1,639,238 | 8/1927 | Tarrant | 404/108 X |
| 1,702,525 | 2/1929 | Smith | 404/108 X |
| 1,748,141 | 2/1930 | Nickerson | 404/110 |
| 1,979,619 | 11/1934 | Hemstreet et al. | 404/110 |
| 2,252,691 | 8/1941 | Arndt | 404/108 X |
| 2,267,022 | 12/1941 | Gledhill | 404/110 |
| 2,800,340 | 7/1957 | Standfuss | 404/108 X |
| 3,029,714 | 4/1962 | Creswell | 404/110 |
| 3,288,041 | 11/1966 | Layton | 404/108 |

*Primary Examiner*—Ernest R. Purser
*Assistant Examiner*—Beverly E. Hjorth
*Attorney, Agent, or Firm*—Herbert E. Haynes, Jr.

[57] ABSTRACT

A manually manipulatable applicator mechanism for applying and embedding crushed rocks on selected areas of a paved surface. The mechanism includes a first gate structure by which an operator can vary the width dimension of the pattern of applied rocks and a second gate structure for controlling the quantity of rocks applied by the mechanism and thus controlling the thickness of the pattern of applied rocks.

20 Claims, 6 Drawing Figures

CRUSHED ROCK APPLICATOR MECHANISM

BACKGROUND OF THE INVENTION

1. Field of the Invention

This invention relates in general to materials spreading devices and more particularly to a manually manipulatable mechanism for applying a layer of crushed rocks in selected areas of a pavement surface.

2. Description of the Prior Art

In the art of highway maintenance, it is a common practice to periodically renew the surface of the pavement by applying what is referred to as a chip seal coat on the existing paved surface. After repair of damaged areas, such as the filling of cracks and chuck holes, a seal coating of asphalt in liquid form is sprayed on the entire paved surface and a coating of crushed rocks, referred to in the industry as chips, is spread on the asphalt while it is still in the uncured state. The surface is then rolled with a special roller vehicle, which embeds the chips in the asphalt seal coating.

The equipment used in this type of highway maintenance is very large and expensive to operate. For example, a chip spreader vehicle which is commonly used in relatively large maintenance projects is a highly specialized automotive vehicle having a chip receiving bin on its back end, a chip dispensing hopper with a power driven auger therein on its front end, and a conveyor system for conveying the chips from the receiving bin to the dispensing hopper. A conventional dump truck is backed up so that its tail gate end is adjacent the chip receiving bin of the chip spreading vehicle, and its dump bed is raised to deliver the chips at a controllable delivery rate into the chip receiving bin. The dump truck is connected to the chip spreading vehicle and is towed by the vehicle as it is operated to accomplish its chip spreading task. This type of highly specialized vehicle is very expensive both from its initial cost and operating cost standpoints and its use is usually reserved for relatively large jobs.

Another type of chip spreader mechanism in common usage is sometimes referred to as a tail gate spreader in that it is mounted on the back of a dump truck to convert it into a special usage machine.

In both of the above described mechanisms, the intended usage thereof is to spread a layer of chips on large areas of the paved surface and the use of either one of those prior art machines cannot be economically justified for spot repair work, such as chuck hole repairing, shoulder work, and the like. For this reason, chuck hole repair work, for example, is usually accomplished by first cleaning out the hole then filling it with an asphalt-aggregate mix, leveling it by hand and finishing the repair by rolling it with a hand operated roller. Since no equipment for applying an asphalt seal coating and applying a chip coating is available, or suitable, for such spot repair work, the chip-seal coating is simply omitted. In the absence of such a coating, the repaired areas are subject to relatively rapid deterioration due to traffic and environmental damage.

To the best of our knowledge, no equipment has been devised or suggested which is suitable for use in applying a layer of crushed rocks, or chips, in relatively small areas where spot repair work is being accomplished on paved surfaces. Therefore, a need exists for a manually manipulatable mechanism for applying a layer of crushed rocks on selected areas of a paved surface.

SUMMARY OF THE INVENTION

In accordance with the present invention, a new and useful manually manipulatable mechanism is disclosed for applying a layer of crushed rocks on selected areas of a paved surface which have been repaired and sealed with a spray coating of uncured liquid asphalt.

The applicator mechanism of the present invention includes a wheeled carriage having a beam means which transversely spans the intended movement path of the mechanism and includes wheel means. The wheel means is preferably in the form of a special wheel-roller structure which is supported by the beam means to provide means for manually moving and manipulating the mechanism and also to provide means for embedding the crushed rocks in the uncured asphalt seal coating. A hopper is supportingly carried by the beam means and is configured to provide an elongated chip dispensing slot at the lower end thereof with the slot being disposed forwardly of the special wheel-roller structure and in parallel relationship with the beam means and extending substantially along the full length of the beam means.

A first gate means is mounted on the hopper structure for adjustably varying the length of the elongated chip dispensing slot and thereby arriving at the desired width of the layer of crushed rocks applicable by the mechanism. This first gate means includes a plurality of slide plates which are arranged in a side-by-side relationship adjacent the chip dispensing slot, with each of the plates being separately and manually repositionable between slot opening and slot closing positions.

A second gate means is also mounted on the hopper structure for varying the width of the elongated chip dispensing slot. At one extreme of the movement of the second gate means, the chip dispensing slot will be fully open as far as its width dimension is concerned and at its other extreme, the chip dispensing slot will be fully closed. The second gate means is selectively positionable at any position between the extremes of its movement for adjustably determining the quantity of crushed rocks flowing through the chip dispensing slot, and thus, adjustably controlling the thickness of the layer of crushed rocks applicable by the mechanism. The second gate means includes an elongated plate which is disposed in coextending relationship with the chip dispensing slot. Movement of this elongated plate is accomplished by power operated linear actuator means in the preferred form of a spacedly arranged pair of electric actuator mechanisms. The power source for the electric actuators is in the form of a storage battery carried by the applicator mechanism with suitable control means being disposed on a handle by which an operator moves and manipulates the applicator mechanism.

Accordingly, it is an object of the present invention to provide a new and useful manually manipulatable mechanism for applying a layer of crushed rocks on selected areas of a paved surface.

Another object of the present invention is to provide a new and useful applicator mechanism of the above described character having a first gate means for adjustably varying the width of the layer of crushed rocks applicable by the applicator mechanism.

Another object of the present invention is to provide a new and useful applicator mechanism of the above described character having a second gate means for adjustably controlling the quantity of crushed rocks dispensible by the applicator mechanism to control the thickness of the layer of crushed rocks applicable thereby and for shutting off the dispensing flow of crushed rocks when desired.

Still another object of the present invention is to provide a new and useful crushed rock applicator mechanism of the above described character having a wheel-roller structure which allows movement and manipulation of the applicator mechanism and rollingly embeds the applied layer of crushed rocks in an uncured coating of liquid asphalt previously applied on the selected area of the paved surface.

The foregoing and other object of the present invention, as well as the invention itself may be more fully understood from the following description when read in conjunction with the accompanying drawings.

DESCRIPTION OF THE PREFERRED EMBODIMENT

Figure 1:
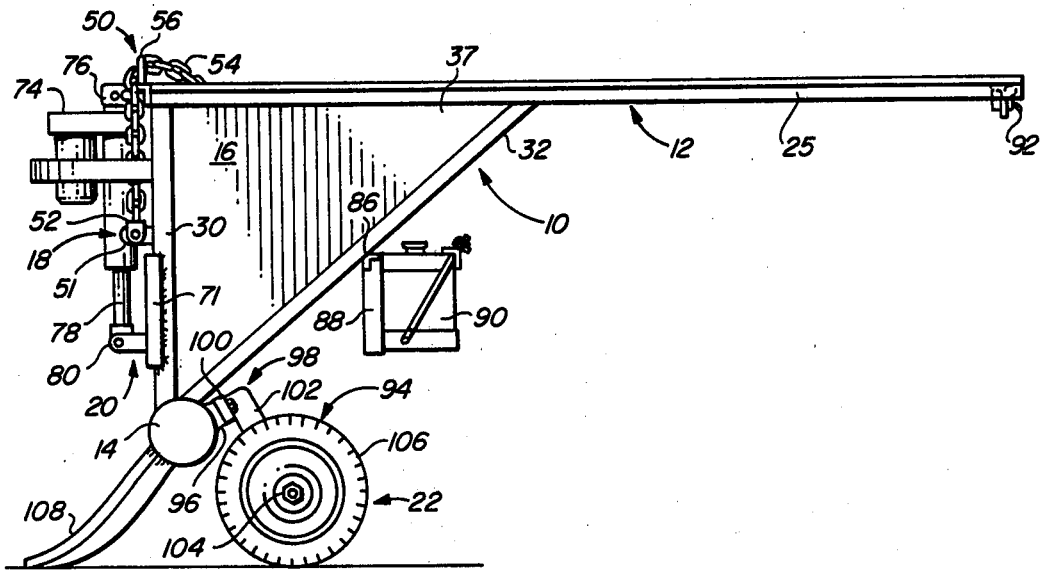
FIG. 1 is a side elevational view of the crushed rock applicator mechanism of the present invention showing the various features thereof.
Figure 2:
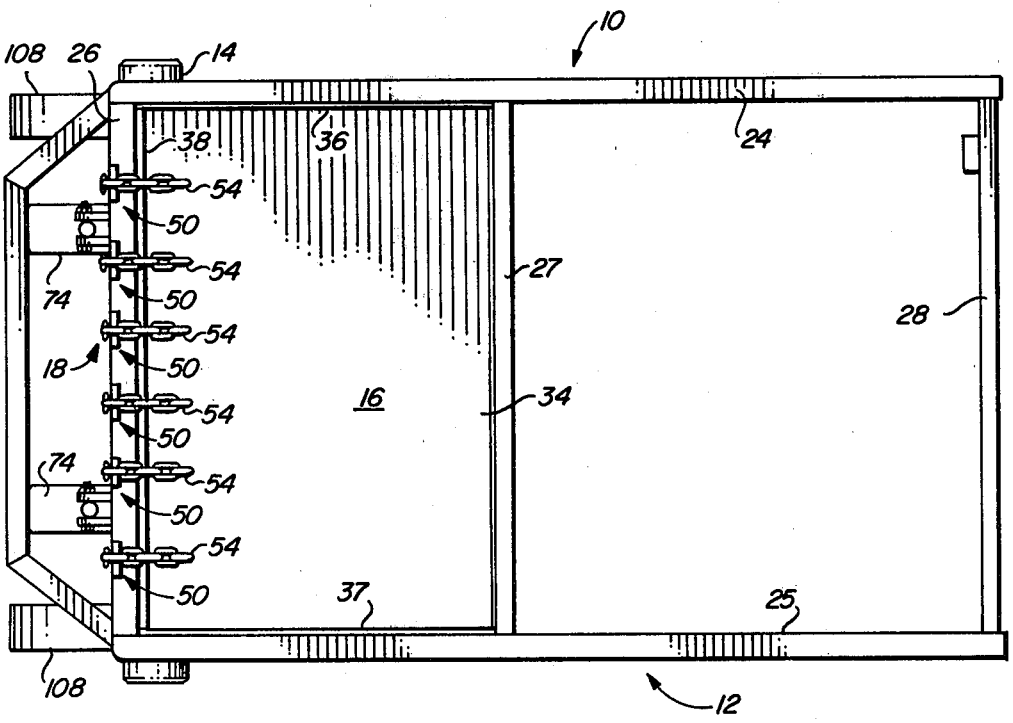
FIG. 2 is a top view of the crushed rock applicator mechanism of the present invention.

Referring more particularly to the drawings, FIGS. 1 and 2 show the manually manipulatable crushed rock applicator mechanism of the present invention which is indicated generally by the reference numeral 10.

As will hereinafter be described in detail, the applicator mechanism 10 includes the basic components of a frame assembly 12 which is fixedly carried on a beam means 14 for supporting a hopper structure 16, and further includes a first gate means 18 and a second gate means 20 for adjustably controlling the dispensing of crushed rocks and wheel means in the preferred form of a special wheel-roller structure 22. The beam means and the wheel means cooperatively forming a wheeled carriage.

Figure 3:
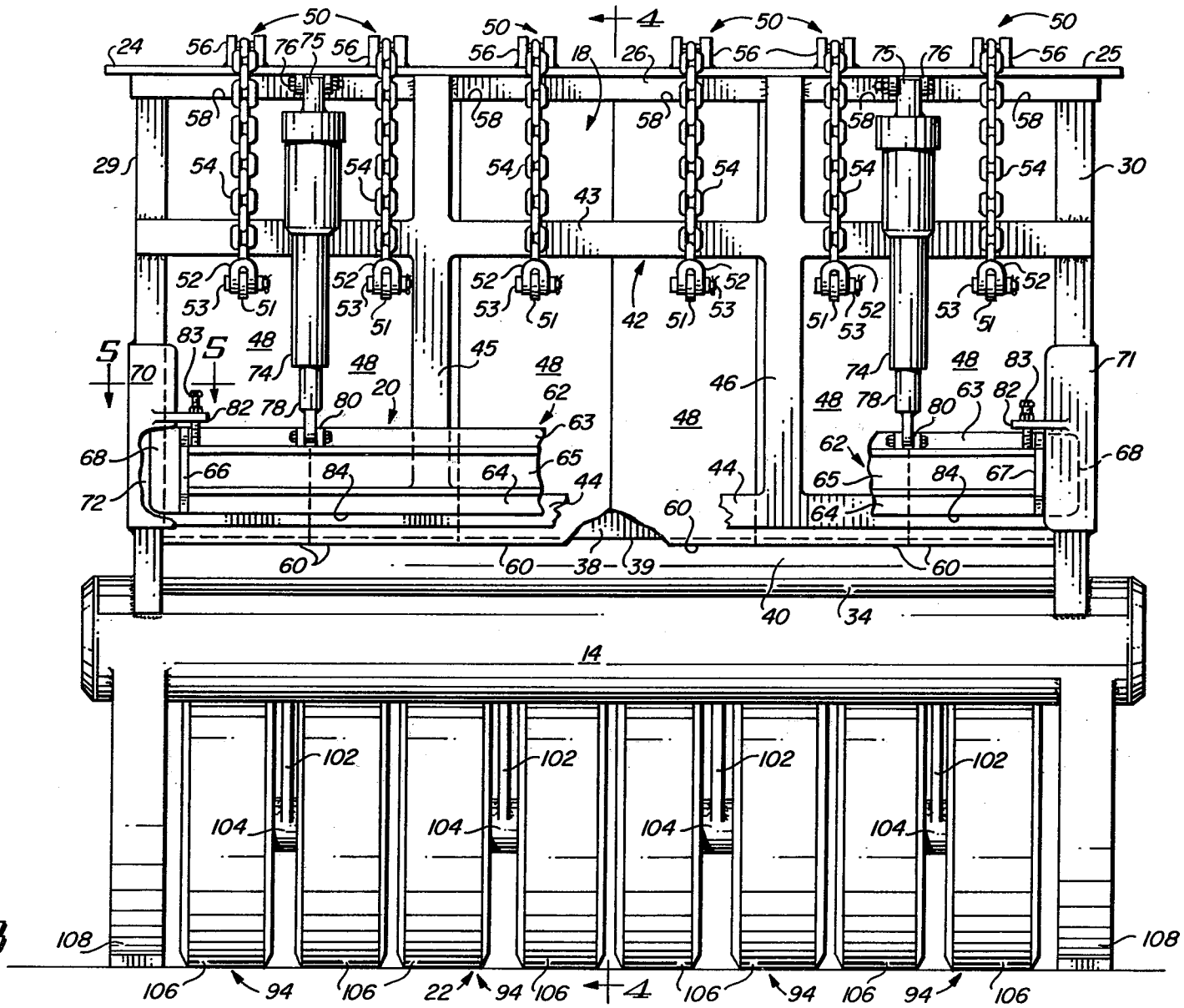
FIG. 3 is an enlarged front elevational view of the applicator mechanism which is partially broken away to shown the various features of the first and second gate means of the applicator mechanism and other structural details thereof.

The frame assembly 12 is essentially formed of angle iron elements or equivalent, and includes a spaced apart parallel pair of top rails 24 ad 25 which are interconnected at their aligned front ends by a front cross rail 26 and have an intermediate interconnecting cross rail 27 and have a tubular rod 28 interconnecting their opposite, or back ends, with the rod 28 serving as a handle by which the applicator mechanism 10 is manually moved and manipulated. The frame assembly 12 also includes a spaced pair of parallel front rails 29 and 30, as best seen in FIG. 3, which depend from the opposite ends of the front cross rail 26 and having their lower ends affixed, such as by welding, to the beam means 14. A spaced pair of back rails 31 and 32 depend angularly and forwardly from intermediate the opposite ends of the top rails 24 and 25, respectively, to the beam means 14, and are affixed in that attitude, such as by welding.

Figure 4:
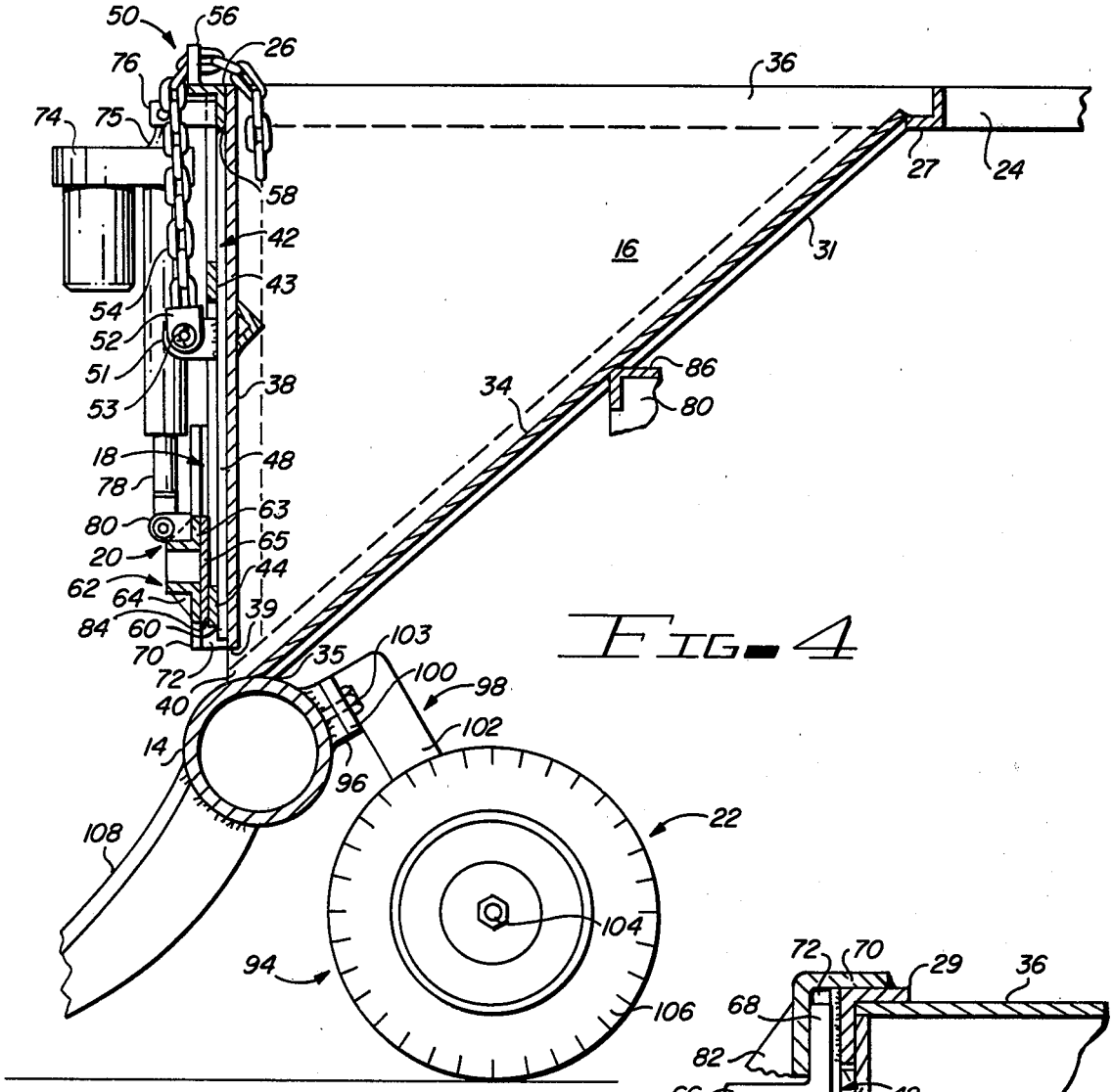
FIG. 4 is a fragmentary sectional view taken along the line 4—4 of FIG. 3.

The forwardly disposed ends of the top rails 24 and 25, the front and intermediate cross rails 26 and 27, the front rails 29 and 30 and the back rails 31 and 32, cooperatively support the hopper structure 16 which, as seen best in FIGS. 1 and 4 is of substantially triangular configuration. The hopper structure 16 is an upwardly opening enclosure having a downwardly and forwardly sloping planar rear wall 34, the opposite side edges of which are fixedly supported by the back rails 31 and 32. The upper edge of the rear wall 34 is affixed to the intermediate cross rail 27 and its lower edge is affixed to the beam means 14 as shown at 35 in FIG. 4. The hopper 16 also includes a pair of planar sidewalls 36 and 37 each of which is of substantially triangular configuration and having their edges fixedly attached to the appropriately disposed top, front and rear rails 24, 25, 29, 30, 31, and 32 of the frame assembly 12. The hopper structure 16 also includes a planar front wall 38 which has its opposite side edges fixedly supported by the front rails 29 and 30, has its upper edge attached to the front rail 26, and has its lower edge 39 in upwardly spaced coextending relationship with respect to the beam means 14 to provide an elongated chip, or crushed rock, dispensing slot 40 therebetween.

The beam means 14 is an elongated tubular structure, preferably of circular cross section, and is disposed to lie transversely of the intended movement path of the applicator mechanism 10 and span that path. The beam means 14 is preferably circular in cross section as mentioned above, so that an arcuate segment thereof, as seen in FIG. 4, is disposed at the bottom of the chip dispensing slot 40 to facilitate the flow of crushed rocks (not shown) from the hopper 16 through the slot 40.

As seen best in FIG. 3, an open frame 42 is provided on the front of the hopper assembly 16 and is disposed to lie in spaced coplanar overlaying relationship with respect to the forwardly facing surface of the front wall 38 of the hopper 16. The open frame 42 includes a spaced pair of horizontally extending slats 43 and 44, the opposite ends of which are fixedly attached to the front rails 29 and 30 of the frame 12, and a spaced pair of vertically extending slats 45 and 46. The upper ends of the vertical slats 45 and 46 are fixedly attached to the front cross rail 26.

The space between the open frame 42 and the forwardly facing surface of the front wall 38 contains a plurality of vertically slidable plates 48 which are diposed in side-by-side relationship with respect to each other and are coplanar with respect to the open frame 42 and the front wall 38. The plural plates 48 are identical and each is provided with an identical positioning means 50 by which the plates may be individually and selectively raised or lowered for reasons which will hereinafter be described in detail.

Since the plural plates 48 and positioning means 50 are identical, it will be understood that the following description of a typical plate 48 and its positioning means 50 will apply to each of the plates and positioning means.

A typical plate 48 is seen to be a substantially planar element of rectangular configuration having a tongue 51 extending forwardly and normally therefrom. A suitable clevis 52 is attached to the tongue such as by means of a pivot pin 53 and one end of a chain 54 is attached to the clevis. The chain 54 is disposed to extend upwardly from the tongue 51 for demountable engagement with an upwardly opening chain retaining yoke 56 which is carried fast on the front cross rail 26 of the frame assembly 12.

The slide plates 48 are all shown in FIG. 3 as being in their raised positions wherein their upper end edges 58 are in abutting engagement with the front cross rail 26 which acts as a stop to prevent the plates from being fully extracted from between the open frame 42 and the front wall 38. When one of the chains 54 is manually raised out of engagement with its retaining yoke 56, the plate may then be lowered to its lower position (not shown) wherein its lower end edge 60 is in engagement with the beam means 14. When so lowered, the plate 48 will move transversely across the elongated chip dispensing slot 40 thus blocking, or closing, that crossed portion of the slot. When all of the plates 48 are in their raised position, the chip dispensing slot 40 will be fully open along its entire length and thus when the applicator mechanism 10 is being used, crushed rocks will flow out of the chip dispensing slot 40 at all points along its length and the rocks will be applied in a pattern having a width dimension approximately equal to the length of the chip dispensing slot. When one or more of the plural plates 48 are lowered to their slot closing positions, the effective length of the chip dispensing slot 40 will be reduced in accordance with the number of plates which are lowered, and thus the rocks will be applied in a pattern having an appropriately reduced width.

The above described plurality of slide plates 48 and positioning means 50 form the hereinbefore mentioned first gate means 18, which as is apparent from the above detailed description, is employed for varying the width of the pattern of crushed rocks applicable by the applicator mechanism 10.

The second gate means 20 as seen best in FIG. 3, includes a single vertically movable elongated plate structure 62 which is disposed to extend substantially horizontally across the front of the applicator mechanism 10 adjacent the elongated chip dispensing slot 40. The elongated plate 62 is formed with horizontal angle members 63 and 64 for rigidification purposes and is provided with a planar sheet 65 which is in vertically slidable engagement with the forwardly facing surface provided by the open frame 42. The elongated plate 62 also includes vertically disposed angle members 66 and 67 on its opposite ends which form laterally and oppositely extending flanges 68.

Figure 5:
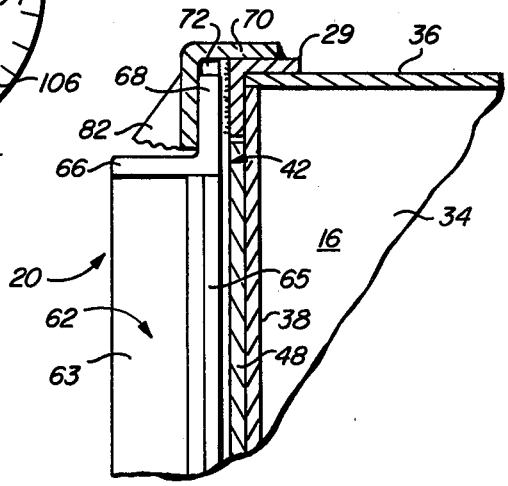
FIG. 5 is an enlarged fragmentary sectional view taken along the line 5—5 of FIG. 3.

Guide brackets 70 and 71 are welded or otherwise affixed to the front rails 29 and 30, respectively, for retaining and guiding the vertically slidable movements of the elongated plate 62. As seen in FIG. 5, wherein the guide bracket 70 is shown, the brackets 70 and 71 are mounted on their respective front rails 29 and 30 so as to provide channels 72 (one shown) in which the oppositely and laterally extending flanges 68 are vertically slidably retained.

Vertical movement of the elongated plate 62 is accomplished by a pair of power operated linear actuators 74. Each of the actuators 74 have a trunnion 75 at their upper ends which are mounted in clevis members 76 that are fixedly carried in spaced apart relationship on the front cross rail 26 of the frame assembly 12. The actuators 74 depend from their clevis mountings and have their linearly extensible members 78 attached to clevis members 80 which are fixedly carried in spaced apart locations on the elongated plate 62.

When the linear actuators 74 are in their retracted states, they will hold the elongated plate 62 in its upwardly disposed position as seen best in FIG. 3. The guide bracket 70 and 71 are each provided with an extending member 82 in which adjustable stops 83 are carried in the form of the illustrated bolt-nut arrangements, and the stops 83 set the limit of vertical upward movement of the elongated plate 62.

When the linear actuators 74 are operated to move them from their retracted positions to their extended positions, as will hereinafter be described in detail, the elongated plate 62 will move downwardly toward the beam means 14 and in doing so will progressively reduce the width dimension of the elongated chip dispensing slot 40. This downward movement will reduce the quantity of crushed rocks which will flow through the chip dispensing slot 40 by virtue of the reduced width of the slot, and rock flow will be fully shutoff when the elongated plate 62 is moved to its lowermost position wherein the lower longitudinal edge 84 of the plate 62 is in engagement with the beam means 14.

It will be apparent from the above that the second gate means 20 may be employed to control the quantity of crushed rocks dispensed by the applicator mechanism 10, and such control is advantageously utilized to determine the thickness of the layer of crushed rocks applied by the mechanism 10 on a paved surface. The second gate means 20 is obviously also used to terminate rock flow when a job has been completed.

The linear actuators 74 may be of any suitable type and are preferably of the electrically operated type. As seen in FIG. 1, the frame assembly 12 is provided with a cross rail 86 extending between its back rails 31 and 32. This cross rail 86 will rigidify the rear wall 34 of the hopper structure 16 and also provide means for supportingly carrying a depending battery box 88, with a conventional battery 90 demountably supported therein. A suitable actuator operating switch 92 is mounted in a bracket carried on the tubular handle 28 of the frame assembly 12 so as to be within easy reach of an operator (not shown) of the mechanism 10.

Figure 6:
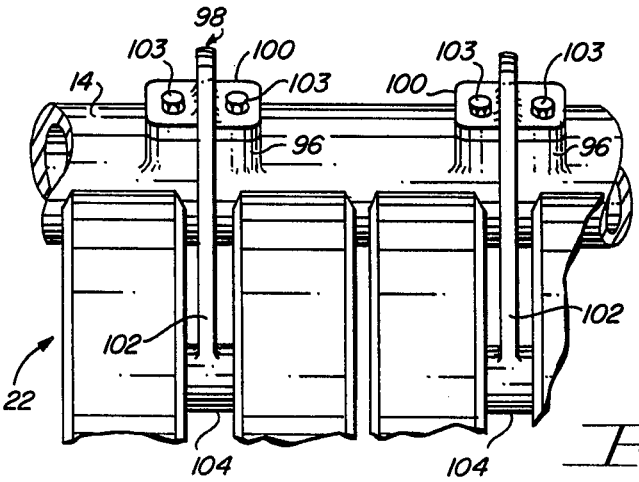
FIG. 6 is an enlarged fragmentary view illustrating the mounting arrangement of the wheel-roller structures provided on the applicator mechanism of the present invention.

The wheel-roller structure 22 as seen best in FIGS. 3, 4 and 6, comprises a plurality of identical wheel assemblies 94 which are demountably attached to the beam means 14. The beam means 14 is provided with a plurality of angularly upwardly and rearwardly extending mounting pads 96 with their being one pad for each wheel assembly 94. Each of the wheel assemblies 94 comprises a carrier bracket 98 which includes a pad 100 having an arm 102 extending therefrom. The pads 100 of the carrier brackets 98 are mounted, such as with suitable bolts 103, to their respective mounting pads 96 provided on the beam means 14. Such mounting of the carrier brackets 98 places the arm 102 thereof in a rearwardly angularly and downwardly extending attitude and the extending ends of those arms are each fixedly attached, such as by welding, to an intermediate point on a different one of a plurality of axle assemblies 104. The axle assemblies 104 extend oppositely from the intermediate points at which the arms 102 are attached thereto and each axle assembly has a pair of wheels 106 rotatably journaled thereon.

The plurality of wheel assemblies are arranged in the above described manner to place them in a location where the applicator mechanism 10 is advantageously balanced for facilitating operator control of the mechanism. Further, the plural wheel assemblies 94 are in substantially axial alignment with each other so that the individual wheels 106 cooperatively span the intended travel path of the applicator mechanism 10 and are disposed to trail immediately behind the chip dispensing slot 40 when the mechanism 10 is being pushed by its operator. In this manner, the wheels 106 will act as a roller on the crushed rocks dispensed by the applicator mechanism 10.

The wheel-roller structure 22 need not be configured in the exact manner described in detail above in that various other configurations will accomplish the desired objectives. For example, a rotatably mounted cylindrical drum (not shown) could be employed.

A pair of forwardly angularly and downwardly extending legs 108 are provided at opposite ends of the beam means 14 for supporting the applicator mechanism 10 in an upright parked position when it is not in use.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

Although the applicator mechanism of the present invention is designed and intended primarily for use in the application of crushed rocks as hereinbefore fully described, it can, of course, be utilized for applying other particulate materials, such as, for example, sand.

The appended claims are therefore intended to cover and embrace any such modifications within the limits only of the true spirit and scope of the invention.

What we claim is:

1. An applicator mechanism for applying a layer of particulate materials on a ground surface over which it is manually movable, said applicator mechanism comprising:

(a) a carriage including wheel means for manual manipulation in a forward direction along an intended movement path by an operator;

(b) an upwardly opening hopper structure supportingly mounted on said carriage for receiving a supply of particulate materials, said hopper structure having an elongated materials dispensing slot formed in the bottom thereof which is disposed to extend transversely of the intended movement path of said carriage;

(c) means on said hopper structure for selectively varying the length and width dimensions of the opening defined by the materials dispensing slot of said hopper structure to control the flow of particulate materials therethrough; and (d) said wheel means of said carriage being disposed in angularly downwardly and rearwardly spaced relationship with respect to the materials dispensing slot of said hopper and in substantially full ground surface engaging contact transversely of the intended movement path of said carriage for rolling over the materials dispensible from the materials dispensing slot when said carriage is moved forwardly along the intended movement path thereof.

2. An applicator mechanism as claimed in claim 1 wherein said carriage comprises:

(a) an elongated beam means disposed to lie transversely of the intended movement path of said carriage and having a portion which faces forwardly and an opposite portion which faces rearwardly, said beam means having said hopper structure mounted thereon and being disposed so that the elongated materials dispensing slot of said hopper structure opens onto the forwardly facing portion of said beam means; and (b) said wheel means being mounted on said beam means so as to extend angularly and downwardly from the rearwardly facing portion thereof.

3. An applicator mechanism as claimed in claim 1 wherein said wheel means of said carriage includes a plurality of juxtaposed wheels which are in substantially axial alignment with respect to each other and extend in substantially parallel relationship with respect to the materials dispensing slot of said hopper structure.

4. An applicator mechanism as claimed in claim 1 wherein said means on said hopper structure for selectively varying the length and width of the materials dispensing slot comprises:

(a) first gate means on said hopper structure adjacent the materials dispensing slot thereof and including a plurality of plates which are individually and selectively movable relative to the materials dispensing slot of said hopper structure for adjustably varying the length dimension of the opening defined by the materials dispensing slot; and (b) second gate means on said hopper structure adjacent the materials dispensing slot thereof and adjustably movable in a direction transverse of the slot for adjustably varying the width dimension of the opening defined by the materials dispensing slot.

5. An applicator mechanism for applying a layer of crushed rocks or other particulate materials on a surface over which it is manually movable, said applicator comprising:

(a) a wheeled carriage for manual manipulation in a forward direction along an intended movement path by an operator;

(b) an upwardly opening hopper structure supportingly mounted on said wheeled carriage for receiving the supply of crushed rocks, said hopper structure having an elongated rock dispensing slot formed in the bottom thereof which is disposed to extend transversely of the intended movement path of said wheeled carriage;

(c) means on said hopper structure for selectively varying the length and width dimensions of the opening defined by the rock dispensing slot of said hopper structure to control the flow of crushed rocks therethrough;

(d) an elongated beam means disposed to lie transversely of the intended movement path of said wheeled carriage and having a portion which faces forwardly and an opposite portion which faces rearwardly, said beam means having said hopper structure mounted thereon and being disposed so that the elongated rock dispensing slot of said hopper structure opens onto the forwardly facing portion of said beam means; and (e) wheel means mounted on said beam means so as to extend angularly and downwardly from the rearwardly facing portion thereof.

6. An applicator mechanism as claimed in claim 5 wherein said means comprises:

(a) first gate means on said hopper structure adjacent the hook dispensing slot thereof and including a plurality of plates which are individually and selectively movable relative to the rock dispensing slot of said hopper structure for adjustably varying the length dimension of the opening defined by the rock dispensing slot; and (b) second gate means on said hopper structure adjacent the rock dispensing slot thereof and adjustably movable in a direction transverse of the slot for adjustably varying the width dimension of the opening defined by the rock dispensing slot.

7. An applicator mechanism as claimed in claim 5 wherein said wheel means extends transversely of the intended movement path of said wheeled carriage for rolling over the crushed rocks dispensible from the rock dispensing slot of said hopper structure when said wheeled carriage is moved forwardly along the intended movement path thereof.

8. An applicator mechanism as claimed in claim 5 wherein said wheel means includes a plurality of juxtaposed wheels which are in substantially axial alignment with respect to each other and extend in substantially parallel relationship with respect to said beam means so as to transversely span the intended movement path of said wheeled carriage.

9. An applicator mechanism as claimed in claim 5 and further comprising:

(a) said hopper structure including a planar front wall which extends substantially upwardly from the rock dispensing slot thereof;

(b) frame means in coplanar spaced relationship with respect to the forwardly facing surface of the front wall of said hopper structure to provide a space therebetween; and (c) first gate means in the space between the front wall of said hopper structure and said frame member and slidably movable toward and away from the rock dispensing slot of said hopper structure, said first gate means including, I. a plurality of individually movable plates in side-by-side relationship, II. means connected to each of said plurality of plates for selective and individual movement thereof.

10. An applicator mechanism as claimed in claim 9 wherein said means connected to each of said plates comprises:

(a) a chain having one end attached to the forwardly facing surface of one of said plurality of plates and extending upwardly therefrom to place the other end thereof proximate the open upper end of said hopper structure; and (b) an upwardly opening yoke mounted at the open upper end of said hopper for demountably receivingly holding a portion of said chain therein.

11. An applicator mechanism as claimed in claim 9 and further comprising:

(a) second gate means including an elongated plate in engagement with the forwardly facing surface of said frame means and disposed in coextending relationship with respect to the rock dispensing slot of said hopper means, said elongated plate slidably movable toward and away from the rock dispensing slot of said hopper structure;

(b) guide brackets on the opposite sides of the front wall of said hopper structure for retaining the opposite ends of said elongated plate and guiding the movements thereof; and (c) means connected to said elongated plate for movement thereof.

12. An applicator mechanism as claimed in claim 11 wherein said means connected to said elongated plate includes at least one power operated linear actuator one end of which is connected to said elongated plate with the other end connected at the upper end of said hopper structure.

13. An applicator mechanism as claimed in claim 12 wherein said linear actuator is electrically operated by means of electric power supplied from a battery supportingly carried by said hopper structure.

14. An applicator mechanism for applying a layer of particulate materials such as crushed rock on a surface over which it is manually movable, said applicator mechanism comprising:

(a) a wheeled carriage for manual manipulation forwardly along an intended movement path;

(b) an upwardly opening hopper on said wheeled carriage for receiving the supply of crushed rocks, said hopper having an elongated rock dispensing slot formed in the bottom thereof which extends transversely of the intended movement path of said wheeled carriage, said hopper including, I. a planar front wall extending substantially upwardly from the rock dispensing slot thereof, II. frame means in coplanar spaced relationship with the forward surface of said front wall to provide a space therebetween, III. first gate means in spaced relationship between said front wall and said frame means and slidably movable toward and away from the rock dispensing slot of said hopper, said first gate means including a plurality of individually movable plates in side-by-side relationship with each of said plates having means for selective and individual movement thereof; and (c) second gate means including an elongated plate in engagement with the forwardly facing surface of said frame means and disposed in coextending relationship with the rock dispensing slot of said hopper, said elongated plate slidably movable toward and away from the rock dispensing slot of said hopper, said second gate means further including, I. guide brackets on the opposite sides of said front wall for retaining the opposite ends of said elongated plate and guiding the movements thereof, II. means connected to said elongated plate for movement thereof.

15. An applicator mechanism as claimed in claim 14 wherein said means connected to each of said plates of said first gate means comprises:

(a) a chain having one end attached to the forwardly facing surface of one of said plurality of plates and extending upwardly therefrom to place the other end thereof proximate the open upper end of said hopper; and (b) an upwardly opening yoke mounted at the open upper end of said hopper for demountably receivingly holding a portion of said chain therein.

16. An applicator mechanism as claimed in claim 14 wherein said means connected to said elongated plate of said second gate means includes at least one power operated linear actuator one end of which is connected to said elongated plate with the other end connected at the upper end of said hopper.

17. An applicator mechanism as claimed in claim 16 wherein said linear actuator is operated by means of electric power supplied by a battery supportingly carried on said hopper.

18. An applicator mechanism as claimed in claim 14 wherein said wheeled carriage includes an elongated beam disposed to lie transversely of the intended movement path of said wheeled carriage and having a portion which faces forwardly and an opposite portion which faces rearwardly, said beam means having said hopper mounted thereon and being disposed so that the elongated slot of said hopper opens onto the forwardly facing portion of said beam.

19. An applicator mechanism as claimed in claim 18 wherein said wheeled carriage further includes wheel means mounted on said beam so as to be disposed in downwardly and rearwardly spaced relationship with respect to the rearwardly facing portion thereof, said wheel means extending transversely of the intended movement path of said wheeled carriage for rolling over the crushed rocks dispensible from the rock dispensing slot of said hopper when said wheeled carriage is moved forwardly along its intended movement path.

20. An applicator mechanism as claimed in claim 19 wherein said wheel means comprises a plurality of juxtaposed wheels in substantial axial alignment with respect to each other and in substantially parallel relationship with the rock dispensing slot of said hopper.

* * * * *